US009347611B2

(12) United States Patent
Ryu et al.

(10) Patent No.: US 9,347,611 B2
(45) Date of Patent: May 24, 2016

(54) SEMI-SUBMERSIBLE OFFSHORE STRUCTURE HAVING STORAGE TANKS FOR LIQUEFIED GAS

(71) Applicant: Daewoo Shipbuilding & Marine Engineering Co., Ltd., Seoul (KR)

(72) Inventors: Min Cheol Ryu, Gyeongsangnam-do (KR); Jun Hyung Jung, Gyeongsangnam-do (KR); Deok Su Kim, Gyeongsangnam-do (KR); Yoon Sik Hwang, Gyeongsangnam-do (KR); Yong Soo Kim, Gyeongsangnam-do (KR); Chuel Hyun Kim, Busan (KR)

(73) Assignee: Daewoo Shipbuilding & Marine Engineering Co., Ltd., Seoul (KR)

( * ) Notice: Subject to any disclaimer, the term of this patent is extended or adjusted under 35 U.S.C. 154(b) by 245 days.

(21) Appl. No.: 13/932,858

(22) Filed: Jul. 1, 2013

(65) Prior Publication Data

US 2013/0291778 A1 Nov. 7, 2013

Related U.S. Application Data

(62) Division of application No. 12/416,337, filed on Apr. 1, 2009, now abandoned.

(30) Foreign Application Priority Data

May 30, 2008 (KR) ..... 10-2008-0050840
Jul. 7, 2008 (KR) ..... 10-2008-0065629

(51) Int. Cl.
*B63B 25/08* (2006.01)
*B65D 88/78* (2006.01)

(Continued)

(52) U.S. Cl.
CPC ..... *F17C 3/027* (2013.01); *F17C 3/005* (2013.01); *F17C 3/025* (2013.01);

(Continued)

(58) Field of Classification Search
CPC ..... F17C 3/025; F17C 3/027; F17C 3/005; F17C 2201/0019; F17C 2201/032; F17C 2205/0119; F17C 2205/013; F17C 2221/033; F17C 2270/011; F17C 2270/0113; F17C 2270/0115; F17C 2270/0118; F17C 2270/0121; F17C 2270/0123; F17C 2270/0128; B63B 2035/448; B63B 21/00; B63B 21/001; B63B 21/003; B63B 21/04; B63B 21/50
USPC ..... 114/74 A, 256; 62/53.1, 45.1
See application file for complete search history.

(56) References Cited

U.S. PATENT DOCUMENTS 3,477,606 A * 11/1969 Schwendtner ..... 220/560.07
3,839,977 A 10/1974 Bradberry (Continued)

FOREIGN PATENT DOCUMENTS

JP 06-298173 10/1994
WO WO 98/56652 12/1998

(Continued)

*Primary Examiner* — Frantz Jules
*Assistant Examiner* — Keith Raymond
(74) *Attorney, Agent, or Firm* — Baker & Hostetler LLP

(57) ABSTRACT

Disclosed herein is a semi-submersible offshore structure having storage tanks for liquefied gas, which is constructed so as to improve workability in marine offloading of the liquefied gas stored in the storage tanks while reducing an influence of sloshing. The offshore structure is anchored at sea and has liquefied gas. The offshore structure includes a storage tank storing liquefied gas, a plurality of columns partially submerged under the sea level and each having the storage tank therein, and an upper deck located on the plurality of columns to connect the columns to each other.

9 Claims, 13 Drawing Sheets

(51) Int. Cl.

| | |
|---|---|
| ***F17C 3/08*** | (2006.01) |
| ***F17C 1/00*** | (2006.01) |
| ***F17C 3/02*** | (2006.01) |
| ***F17C 3/00*** | (2006.01) |
| *B63B 35/44* | (2006.01) |

(52) U.S. Cl.

CPC .. *B63B 2035/448* (2013.01); *F17C 2201/0104* (2013.01); *F17C 2201/0119* (2013.01); *F17C 2201/0128* (2013.01); *F17C 2201/0157* (2013.01); *F17C 2201/0166* (2013.01); *F17C 2201/032* (2013.01); *F17C 2201/035* (2013.01); *F17C 2201/052* (2013.01); *F17C 2203/03* (2013.01); *F17C 2203/0617* (2013.01); *F17C 2205/013* (2013.01); *F17C 2205/0119* (2013.01); *F17C 2205/0142* (2013.01); *F17C 2205/0184* (2013.01); *F17C 2221/033* (2013.01); *F17C 2223/0161* (2013.01); *F17C 2223/033* (2013.01); *F17C 2260/016* (2013.01); *F17C 2270/011* (2013.01); *F17C 2270/0113* (2013.01); *F17C 2270/0115* (2013.01); *F17C 2270/0118* (2013.01); *F17C 2270/0121* (2013.01); *F17C 2270/0123* (2013.01); *F17C 2270/0128* (2013.01)

(56) References Cited

U.S. PATENT DOCUMENTS

| | | | | |
|---|---|---|---|---|
| 5,269,247 | A | 12/1993 | Jean | |
| 5,501,359 | A | 3/1996 | Chauvin et al. | |
| 7,140,317 | B2 * | 11/2006 | Wybro et al. | 114/264 |
| 2002/0090270 | A1 | 7/2002 | Malcolm et al. | |
| 2007/0102940 | A1 | 5/2007 | Hansen | |
| 2009/0078185 | A1 * | 3/2009 | Poldervaart et al. | 114/256 |

FOREIGN PATENT DOCUMENTS

| | | | |
|---|---|---|---|
| WO | WO 99/25608 | | 5/1999 |
| WO | WO99/25608 | * | 5/1999 |

* cited by examiner

SEMI-SUBMERSIBLE OFFSHORE STRUCTURE HAVING STORAGE TANKS FOR LIQUEFIED GAS

CROSS REFERENCE TO RELATED APPLICATIONS

This application is a divisional of U.S. patent application Ser. No. 12/416,337, filed Apr. 1, 2009, which claims priority to and the benefit of Korean Patent Application Nos. 10-2008-0050840 filed May 30, 2008, and 10-2008-0065629 filed Jul. 7, 2008, the entire contents of which are hereby incorporated by reference.

TECHNICAL FIELD

The present invention relates to a semi-submersible offshore structure having storage tanks for liquefied gas such as liquefied natural gas (LNG) and, more particularly, to a semi-submersible offshore structure having storage tanks for liquefied gas that is constructed so as to improve workability in marine offloading of the liquefied gas stored in the storage tanks while reducing an influence of sloshing.

BACKGROUND

Natural gas is transported long distances in a gaseous state to consumers through a gas pipe line over land or sea, or is transported in an LNG state by LNG carriers. LNG is obtained by cooling natural gas into a cryogenic state (about −163) where the volume of the natural gas is reduced to about 1/600 that at standard temperature and pressure, which makes it eminently suitable for long distance marine transportation.

Recently, demand for floating offshore structures such as LNG FPSO (floating, production, storage and offloading), LNG FSRU (floating storage and regasification unit) or the like have been increasing. The floating offshore structure is also provided with storage tanks which are provided to LNG carriers or LNG RVs (regasification vessels), and, if necessary, with an LNG liquefaction or regasification system.

The LNG FPSO is a floating offshore structure that can directly liquefy produced natural gas into LNG at sea to store the LNG in the storage tanks thereof and to deliver the LNG stored in the storage tanks to another LNG carrier, as needed. The LNG FSRU is a floating offshore structure that can store LNG, unloaded from an LNG carrier, in the storage tank at sea a long distance from the land and can gasify the LNG as needed, thereby supplying the regasified LNG to consumers on the land.

The floating offshore structures, such as LNG FPSO, LNG FSRU and the like, which can store liquid cargo such as LNG on the sea, are generally provided as barges, which are anchored by a single-point mooring system such as turret or Yoke mooring.

However, such a barge type floating offshore structure is sensitive to marine conditions and is likely to fluctuate according to the marine conditions, and particularly suffers a sloshing phenomenon within the storage tanks due to roll movement of the offshore structure and workability deterioration due to large relative movement with respect to an LNG carrier near the floating offshore structure during an offloading operation.

Excessive fluctuation of the floating offshore structure, sloshing in the storage tank, and resonance motion of the offshore structure can make it difficult to operate various systems provided to the offshore structure or can cause severe sloshing in the storage tank. Herein, "sloshing" refers to movement of a liquid substance, that is, LNG, stored in the storage tank when a floating structure such as vessels moves in various marine conditions, and imparts severe impact to a wall of the storage tank.

In particular, since partial loading of a liquid cargo in the storage tank causes a severer sloshing phenomenon, the LNG carrier regulates a loading amount of LNG to be stored in a cargo tank. However, since it is difficult for the floating offshore structure to regulate the loading amount of LNG in the storage tank thereof, the floating offshore structure inevitably suffers impact caused by sloshing upon partial loading of LNG.

Conventionally, in use of membrane type storage tanks which have a relatively low strength, it has been proposed to arrange the membrane type storage tanks in two arrays with a partition disposed therebetween. Alternatively, it has been proposed to use independent type storage tanks. However, the arrangement of the membrane type storage tanks in two arrays leads to a decrease of storage capacity and the use of the independent type storage tanks require an increase of manufacturing costs.

On the other hand, when LNG is supplied from the floating offshore structure to the LNG carrier (in the case of the LNG FPSO) or vice versa (in the case of the LNG FSRU), it is necessary for the LNG carrier to be placed near the offshore structure. However, since the conventional floating offshore structure has the barge structure that is sensitive to marine conditions and fluctuates as described above, the conventional floating offshore structure provides low workability during LNG offloading due to large relative movement with respect to the LNG carrier placed adjacent thereto.

SUMMARY

The present invention is conceived to solve the problems as described above, and an aspect of the present invention is to provide a semi-submersible offshore structure which includes storage tanks for storing liquefied gas to improve workability in marine offloading of the liquefied gas in the storage tanks while reducing an influence of sloshing.

In accordance with an aspect of the present invention, a semi-submersible offshore structure anchored at sea and storing liquefied gas includes: a storage tank storing liquefied gas; a plurality of columns partially submerged under the sea and each having the storage tank therein; and an upper deck located on the plurality of columns to connect the columns to each other.

Each of the columns may be provided at a lower side thereof with a pontoon to reduce fluctuation of the semi-submersible offshore structure and to adjust ballast.

The pontoon may connect two or more columns to each other.

The plurality of columns may comprise a plurality of horizontal columns extending horizontally relative to the sea level and disposed in parallel.

The horizontal column may be provided at an upper side thereof with a connecting member which connects the horizontal column to the upper deck.

The semi-submersible offshore structure may further include a column bridge provided to the columns to bridge an LNG carrier to the offshore structure.

The column bridge may connect adjacent columns to each other, and may include a mooring rope for securing the LNG carrier, and an offloading arm disposed between the LNG carrier and the semi-submersible offshore structure to transfer liquefied gas therebetween.

The column bridge may be positioned at an installation height corresponding to a deck height of the LNG carrier.

The semi-submersible offshore structure may further include a fender disposed on an outer surface of the column to prevent direct contact between the semi-submersible offshore structure and the LNG carrier for buffering operation therebeween.

The storage tank in each of the columns may be divided into two or more chambers by a partition.

Each of the columns may have a shape selected from a cylindrical shape and a square pillar shape.

The storage tank may have a shape selected from a cylindrical shape and a rectangular parallelepiped shape.

The horizontal column may have a cylindrical shape and the pontoon may have a partially cut triangular cross-section, an upper portion of which is cut into a cylindrical shape corresponding to an outer circumference of the horizontal column such that a bottom edge of the pontoon extends outside the horizontal column.

The horizontal column may have a square pillar shape and the pontoon may have a triangular cross-section which has opposite ends symmetrically extending from right and left sides of the horizontal column.

The plurality of columns may comprise four columns disposed in an oblong arrangement and standing perpendicular to sea level, and the pontoons may comprise a pair of pontoons, on each of which two adjacent columns are positioned.

The semi-submersible offshore structure may be one selected from LNG FPSO and LNG FSRU.

The storage tank may be a membrane type storage tank.

In accordance with another aspect of the present invention, a semi-submersible offshore structure anchored at sea and storing liquefied gas includes: a plurality of columns disposed in parallel and each having a storage tank therein; and an upper deck connecting the plurality of columns to each other.

Each of the columns may be provided with a pontoon extending outside the column to reduce fluctuation of the semi-submersible offshore structure and to adjust ballast In accordance with a further aspect of the present invention, a drilling rig ship-type semi-submersible offshore structure anchored at sea and storing liquefied gas includes: a plurality of columns disposed in an oblong arrangement and each having a storage tank therein; an upper deck connecting upper sides of the plural columns to each other; and a pontoon connecting lower sides of the plural columns to each other.

BRIEF DESCRIPTION OF THE DRAWINGS

The above and other aspects, features and advantages of the present invention will become apparent from the following description of exemplary embodiments given in conjunction with the accompanying drawings, in which.

DETAILED DESCRIPTION OF ILLUSTRATIVE EMBODIMENTS

Figure 1:
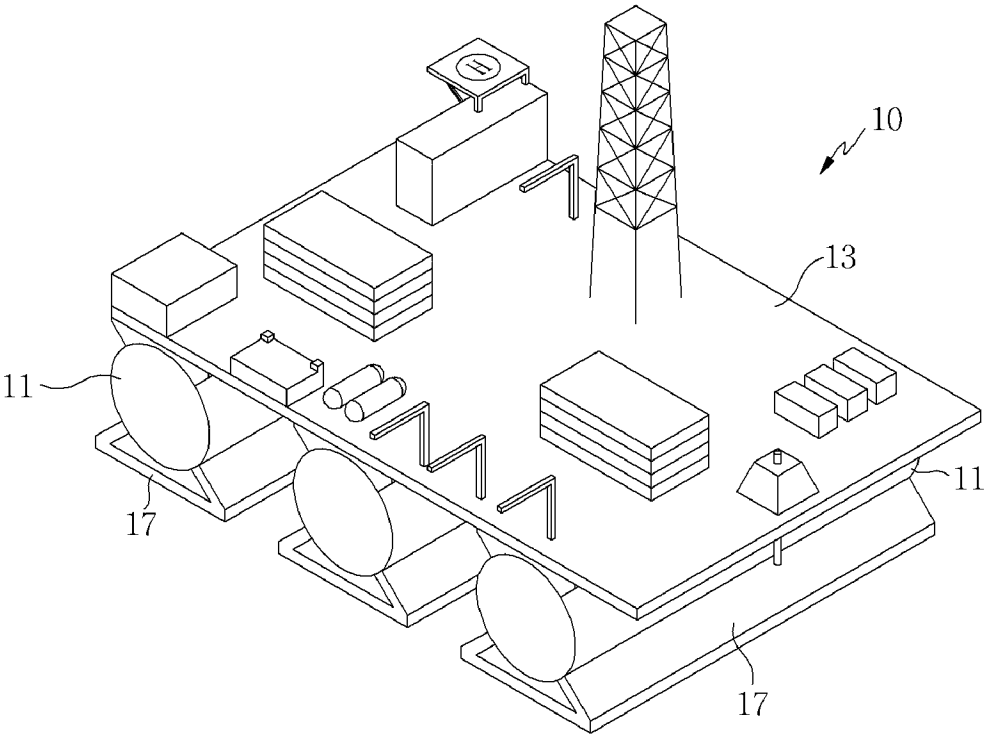
FIGS. 1 and 2 are a perspective view and a side view of a semi-submersible offshore structure according to a first embodiment of the present invention.

Exemplary embodiments of the present invention will now be described in detail with reference to the accompanying drawings.

Referring to FIGS. 1 to 4, a semi-submersible offshore structure 10 according to a first embodiment of the invention includes a plurality of horizontal columns 11 extending horizontally relative to the sea level and disposed in parallel, and an upper deck 13 disposed on the plurality of horizontal columns 11 to connect the horizontal columns 11 to each other.

The horizontal column 11 has a cylindrical shape and is provided therein with a cylindrical storage tank 15 that stores liquefied gas such as LNG. One or more storage tanks 15 may be disposed in the horizontal column 11. For example, the storage tank 15 may be divided into two or three parts by one or more partitions along the horizontal column 11.

The storage tank 15 may be any typical storage tank such as a membrane type storage tank or an independent type storage tank. According to this embodiment, the membrane type storage tank may be used as the storage tank in terms of manufacturing costs since the floating offshore structure of this invention can significantly reduce a sloshing phenomenon.

In the drawings, three horizontal columns 11 are disposed in parallel to each other, but it should be noted that the present invention is not limited thereto. Since the horizontal column 11 has a cylindrical shape in the first embodiment, each of the horizontal columns 11 may be provided at an upper side thereof with a connecting member 11*a* for connection to the upper deck 13.

Figure 2:
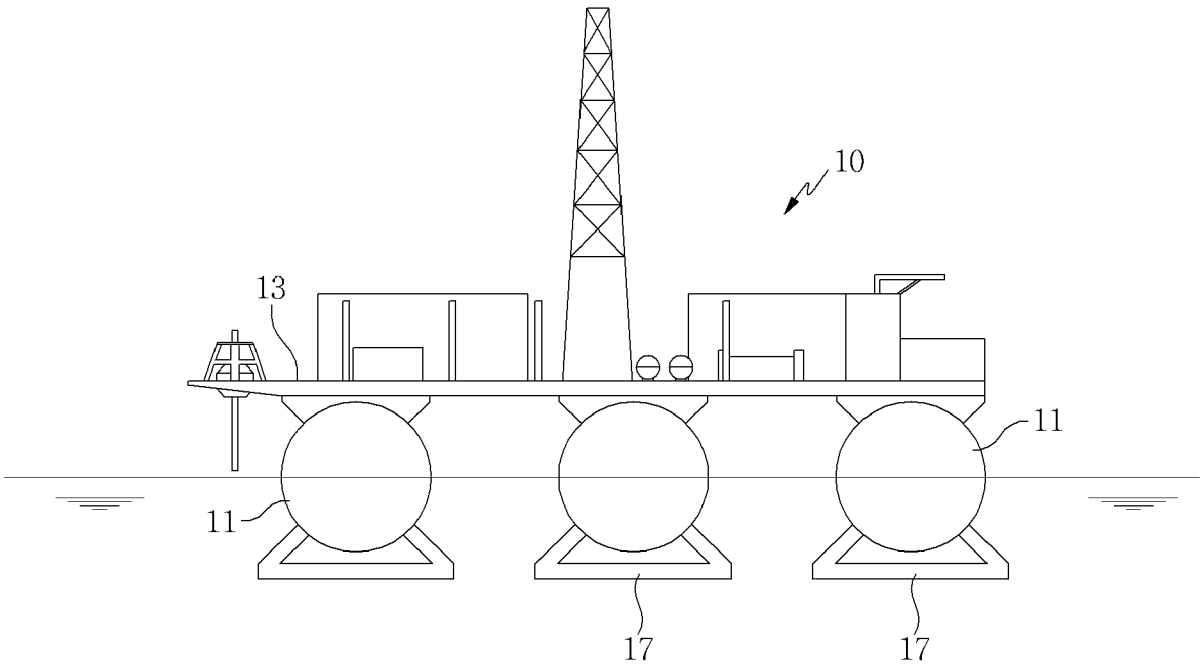
Figure 3:
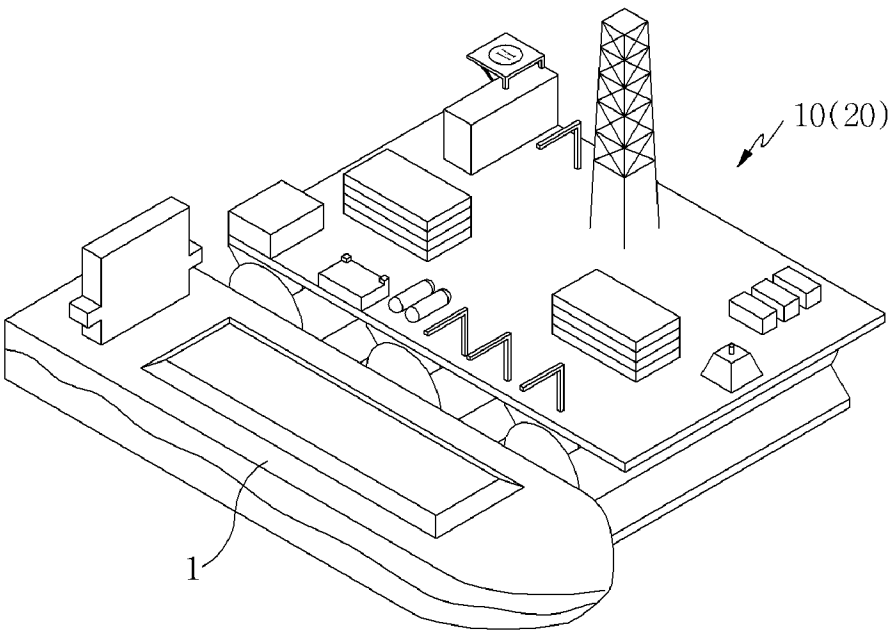
FIG. 3 is a perspective view of the semi-submersible offshore structure according to the first embodiment during offloading operation.
Figure 4:
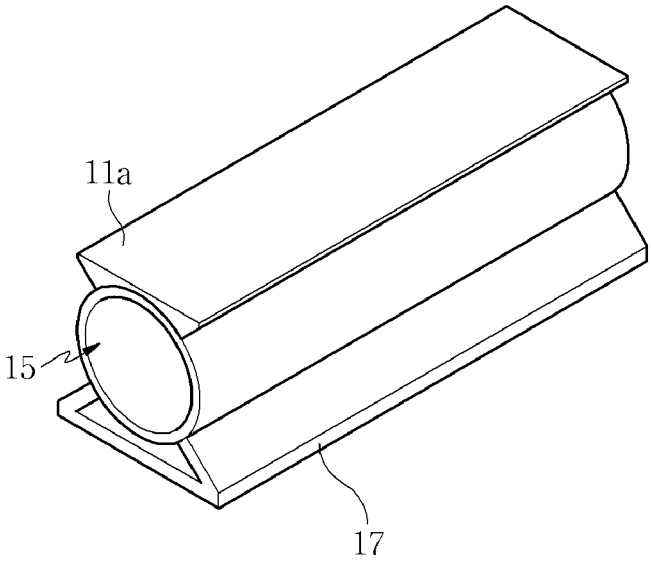
FIG. 4 is a perspective view of horizontal columns of the semi-submersible offshore structure according to the first embodiment of the present invention.
Figure 5:
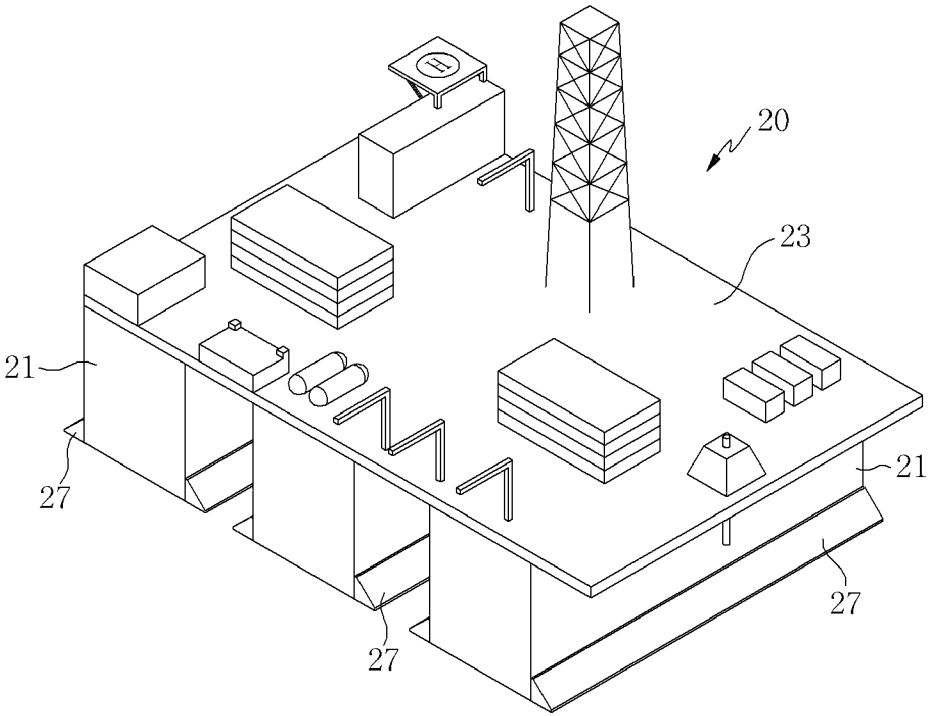
FIGS. 5 and 6 are a perspective view and a side view of a semi-submersible offshore structure according to a second embodiment of the present invention.
Figure 6:
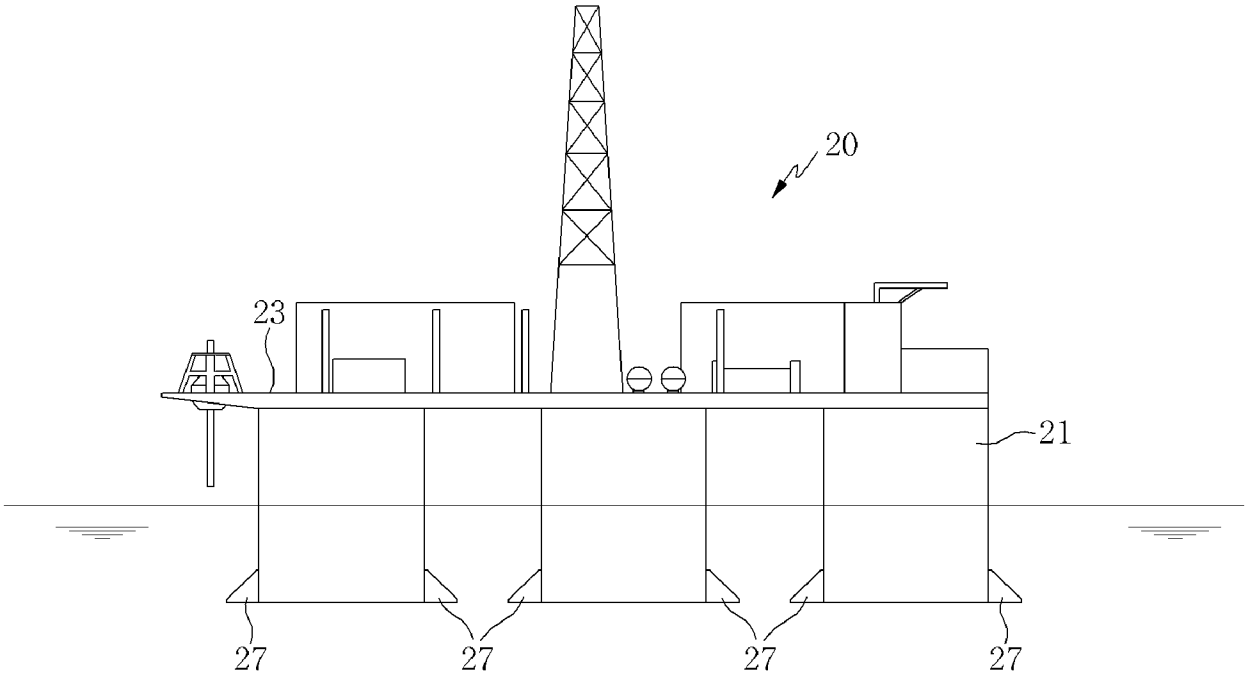
Figure 7:
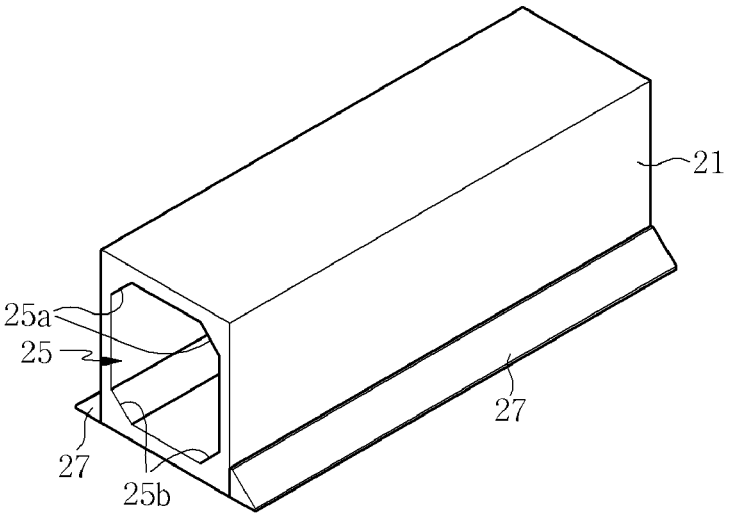
FIG. 7 is a perspective view of horizontal columns of the semi-submersible offshore structure according to the second embodiment of the present invention.

The horizontal column 11 is provided at a lower side thereof with a pontoon 17 which reduces a vertical heaving or pitch phenomenon of the offshore structure and is used to adjust ballast. In the first embodiment, the pontoon 17 has a triangular shape, an upper portion of which is cut corresponding to an outer circumference of the cylindrical horizontal column 11. As shown in FIG. 2, the pontoon 17 is provided to each of the horizontal columns 17 and may have a greater bottom side than a diameter of the horizontal column 11 such that a bottom edge of the pontoon 17 extends outside the horizontal column 11.

The upper deck 13 may be provided with a variety of systems for use in the offshore structure, and arrangement or kinds thereof do not limit the present invention.

Further, the upper deck 13 may be provided with a turret or spread type mooring system for anchoring the offshore structure, and arrangement or kinds thereof do not limit the present invention.

In the drawings, the plural horizontal columns 11 are connected to each other by the upper deck 13 only through the upper sides thereof, but may also be connected to each other by an integral pontoon 17 through the lower sides thereof.

Referring to FIGS. 5 to 8, a semi-submersible offshore structure 20 according to a second embodiment of this invention includes a plurality of horizontal columns 21 extending horizontal to the sea level and disposed in parallel, and an upper deck 23 disposed on the plural horizontal columns 21 to connect the horizontal columns 11 to each other as in the offshore structure of the first embodiment.

In this embodiment, however, each of the horizontal columns 21 has a square pillar shape. Herein, the second embodiment will be described in view of different configuration from the first embodiment.

Each of the horizontal columns 21 is provided therein with a storage tank 25 that stores liquefied gas such as LNG and has a rectangular parallelepiped shape. One or more storage tanks 25 may be provided in each of the horizontal columns 21. For example, the storage tank 25 may be divided into two or more parts by one or more partitions along the horizontal column 21.

The storage tank 25 may be any typical storage tank such as a membrane type storage tank or an independent type storage tank. According to this embodiment, the membrane type storage tank may be used as the storage tank in terms of manufacturing costs since the offshore structure of this invention can significantly reduce the sloshing phenomenon.

When the membrane type storage tank is used as the storage tank of the offshore structure, the storage tank 25 in the rectangular parallelepiped horizontal column 21 may be formed at upper and lower portions thereof with upper and lower chambers 25*a* and 25*b* to reduce the sloshing phenomenon. The sizes and positions of the upper and lower chambers 25*a* and 25*b* may be determined according to an evaluated sloshing load.

The horizontal column 21 is provided at a lower side thereof with pontoons 27 which reduce a vertical heaving or pitch phenomenon of the offshore structure and are used to adjust ballast. In the second embodiment, each of the pontoons 27 may have a horizontally elongated triangular prism shape, and a pair of right and left pontoons 27 may be symmetrically provided to right and left sides of the horizontal column 21.

In the second embodiment, the pair of right and left pontoons 27 is provided to each of the horizontal columns 21 such that the right and left pontoons 27 extend from the right and left sides of the horizontal column 21, respectively.

The upper deck 23 of the second embodiment is the same as that of the first embodiment, and a detailed description thereof will be omitted herein. Further, it should be noted that the respective pontoons 27 may be integrally connected to each other at the lower sides of the plural horizontal columns 21.

Figure 8:
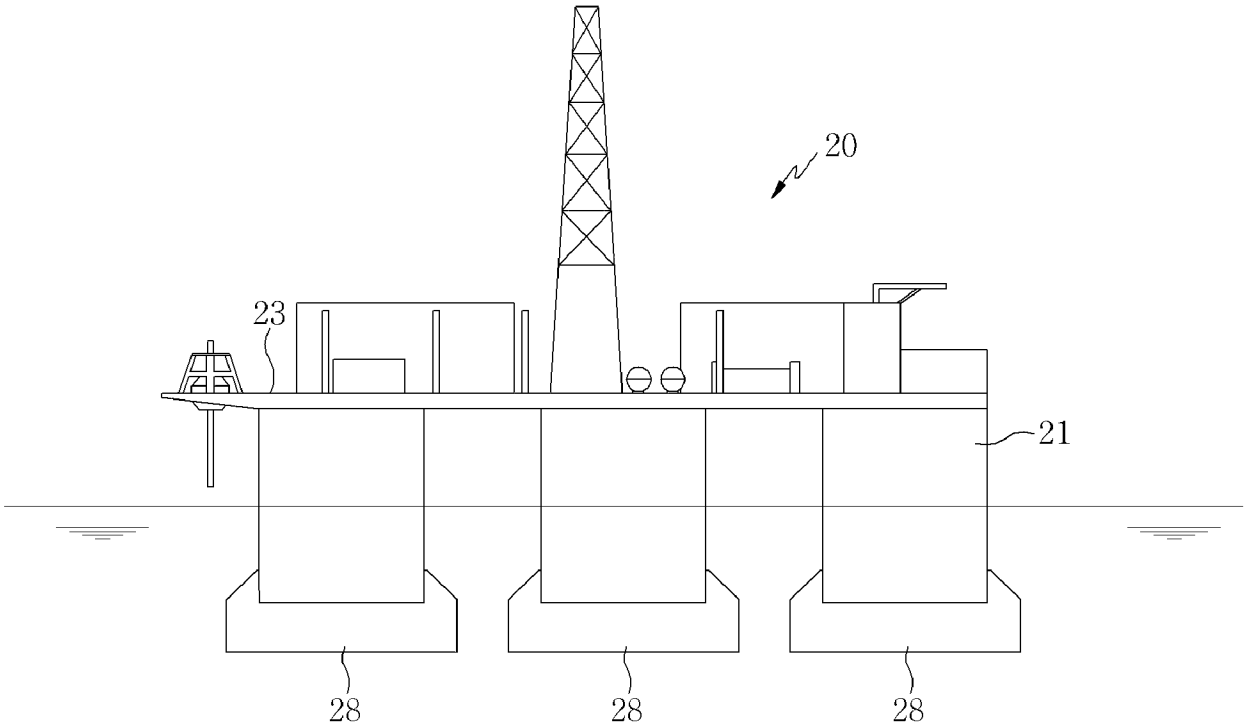
FIG. 8 is a side view of a semi-submersible offshore structure according to a modification of the second embodiment of the present invention.

Further, if there is a need for a pontoon having a large volume, the pontoon 27 may be configured to surround the lower side of the column 21 as shown in FIG. 8.

In the first and second embodiments, the horizontal column has a cylindrical or square pillar shape. However, it should be noted that the semi-submersible offshore structure of the present invention is not limited thereto. Further, the storage tank in the horizontal column may have a variety of shapes, and may have a spherical, cylindrical or rectangular parallelepiped shape in view of manufacturing convenience and costs.

According to an alternative embodiment, the plural horizontal columns may have different shapes from each other.

As described above, in the semi-submersible offshore structures 10, 20 of the first and second embodiments, the storage tanks 15, 25 are disposed within the plurality of horizontal columns 11, 21 extending horizontal to the sea level and disposed in parallel, so that the offshore structures 10, 20 have an increased width to length ratio.

As a result, the semi-submersible offshore structures 10, 20 do not make sensitive fluctuation relating to marine conditions, thereby providing stability while significantly reducing the sloshing phenomenon. Further, the upper decks 13, 23 of the offshore structures 10, 20 have an increased area compared with the conventional offshore structure, thereby facilitating arrangement and design of various systems thereon.

Further, since the semi-submersible offshore structures 10, 20 can reduce an influence of sloshing, storage tanks having a large volume can be disposed in the columns so as to ensure a sufficient storage capacity of the storage tanks 15, 25.

Furthermore, since the semi-submersible offshore structures 10, 20 are not sensitive to marine conditions and fluctuate less, relative movement between the offshore structures 10, 20 and the LNG carrier 1 is reduced during an offloading operation for unloading or loading liquefied gas from the offshore structures 10, 20 to the LNG carrier 1 or vice versa, thereby improving workability.

Referring to FIGS. 9 to 13, a semi-submersible offshore structure 30 according to a third embodiment of this invention is generally similar to a semi-submersible drilling rig ship in overall configuration. The semi-submersible offshore structure 30 according to the third embodiment includes a plurality of columns 31 disposed substantially perpendicular to the sea level, an upper deck 33 disposed on the plural columns 31 to connect the columns 31 to each other, and a pontoon 37 disposed at lower sides of the columns 31 to connect the columns 31 to each other.

Each of the columns 31 has a substantially cylindrical or square pillar shape and is provided therein with a cylindrical storage tank 35 that stores liquefied gas such as LNG. One or more storage tanks 35 may be provided in each of the columns 31. For example, storage tank 35 may be divided into two or more parts by one or more partitions in the vertical direction of the column 31.

The storage tank 35 may be any typical storage tank such as a membrane type storage tank or an independent type storage tank. According to this embodiment, the membrane type storage tank may be used as the storage tank in terms of manufacturing costs since the offshore structure of this invention can significantly reduce the sloshing phenomenon.

On the other hand, in the drawings, four horizontal columns 31 are disposed in an oblong arrangement (herein, the term "oblong" includes the meanings of a rectangular shape and a square shape) and two of them are provided to one pontoon 37. However, it should be noted that the number of horizontal columns 31 is not limited to four.

According to the third embodiment, the column 31 and the storage tank 35 may have a polygonal column shape as well as a square pillar or cylindrical shape. Particularly, the storage tank 35 may have a shape of any membrane type storage tank, such as a cylindrical or rectangular parallelepiped shape. However, it should be noted that the present invention is not limited thereto and the storage tank 35 may have other shapes.

According to the present invention, the column 31 may have the same or a different shape than the storage tank 35. For example, both the column 31 and the storage tank 35 may have a cylindrical shape. Alternatively, the column 31 may have a cylindrical shape and the storage tank 35 may have a rectangular parallelepiped shape.

As described above, the pontoon 37 positioned at the lower side of the column 31 serves to reduce a vertical heaving or pitch phenomenon of the offshore structure and is used to adjust ballast. It is desirable that the pontoon 37 not include a storage tank therein. If the storage tank is formed in the pontoon 37, there is a need for a separate large ballast in order to ensure buoyancy of the structure, which cannot be applied in practice.

According to the third embodiment, the semi-submersible offshore structure may have a pair of pontoons 37, on each of which half of the plural columns 31 are positioned. For example, when the offshore structure includes four columns 31, two columns 31 are disposed on a single pontoon 37. Arrangement of the columns and pontoons may be the same as that of the typical rig ship.

The upper deck 33 may be provided with a variety of systems for use in the offshore structure, and arrangement or kinds thereof do not limit the present invention.

Figure 9:
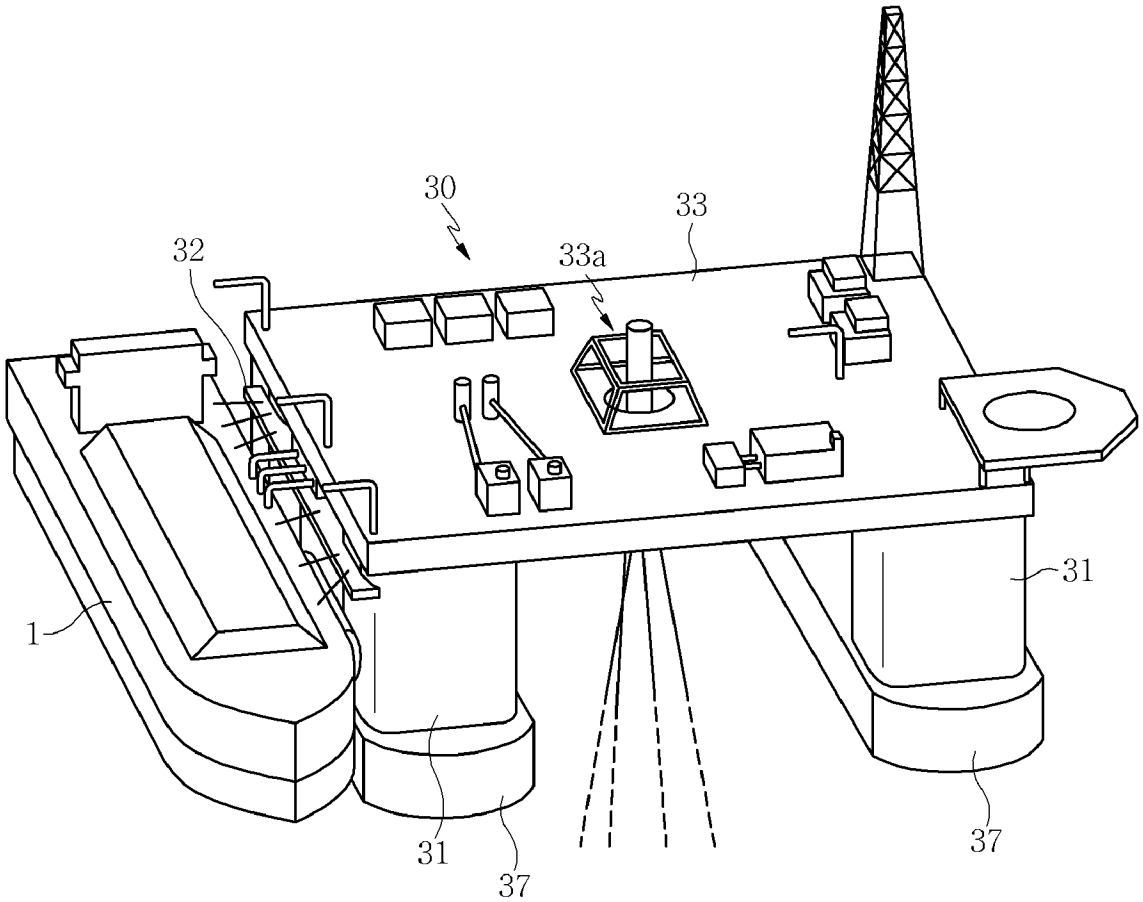
FIGS. 9 and 10 are a perspective view and a side view of a semi-submersible offshore structure according to a third embodiment of the present invention.
Figure 10:
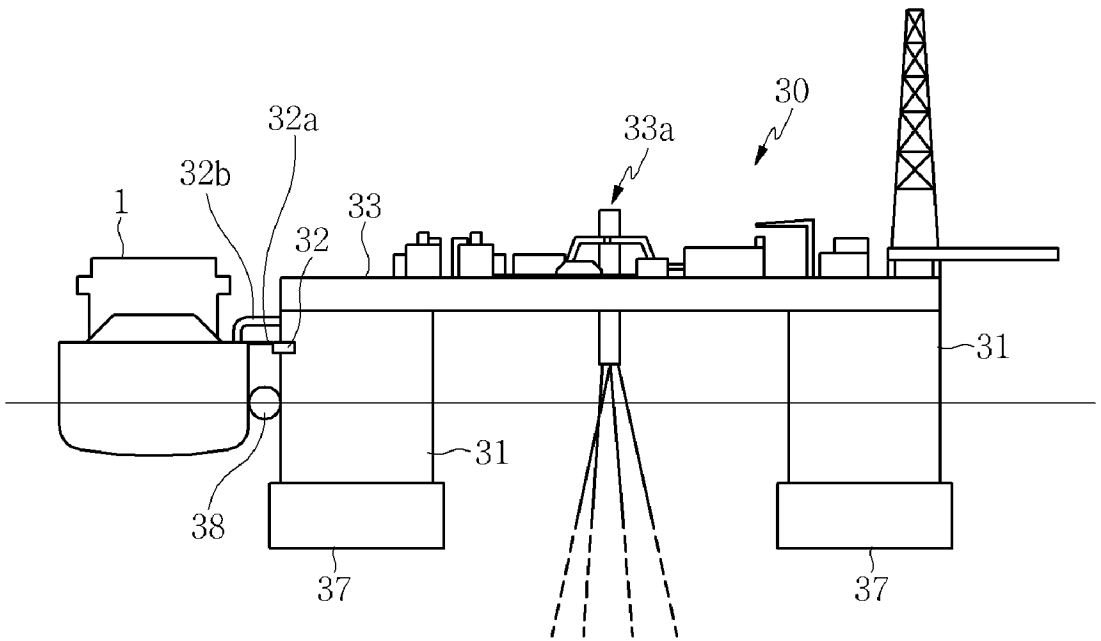

Further, the upper deck 33 may be provided with a turret or spread type mooring system for anchoring the offshore structure, and arrangement or kinds thereof do not limit the present invention. In FIGS. 9 and 10, a turret system 33 is illustrated as being positioned at the center of the upper deck 33 for anchoring the semi-submersible offshore structure according to the third embodiment, but such a mooring system may be positioned at one side of the upper deck 33.

Figure 11:
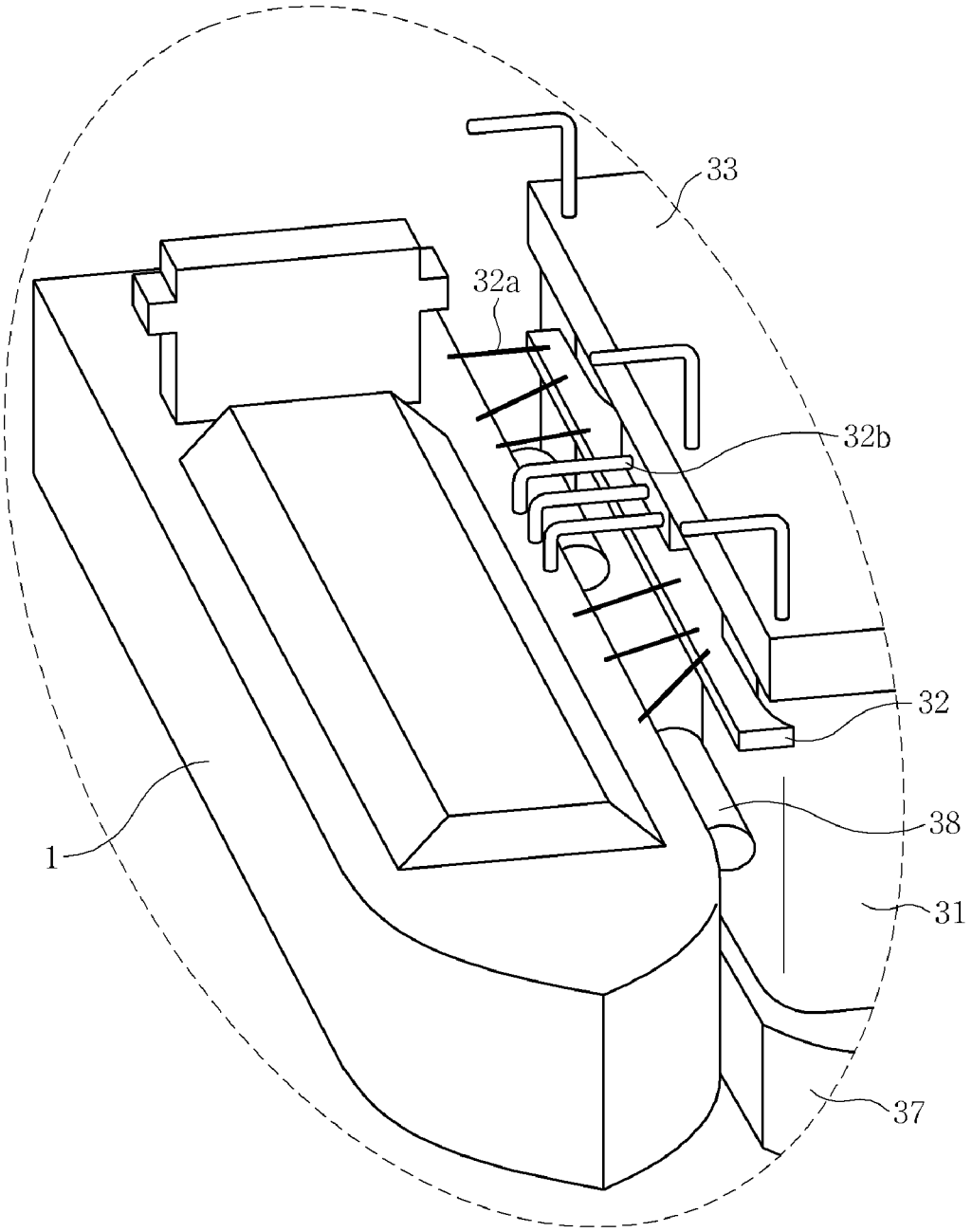
FIG. 11 is a partially enlarged perspective view of the semi-submersible offshore structure according to the third embodiment during an offloading operation.

As specifically shown in FIG. 11, the semi-submersible offshore structure 30 according to the third embodiment may further include a column bridge 32 which enables the LNG carrier 1 to be easily secured to the semi-submersible offshore structure 30 by a mooring rope 32*a* or the like during an offloading operation of unloading or loading liquefied gas from the semi-submersible offshore structure 30 to the LNG carrier 1 or vice versa.

The column bridge 32 is provided in parallel to the pontoon 37 to connect upper portions of the columns to each other. The column bridge 32 may be positioned at an installation height corresponding to the height of the LNG carrier 1.

Typically, since only a single LNG carrier 1 can be anchored along with the semi-submersible offshore structure 30, the column bridge 32 is generally provided to one side of the semi-submersible offshore structure 30, but may also be provided to either side thereof, as needed.

The column bridge 32 may be provided with an offloading arm 32*b* through which a liquid cargo such as LNG can be loaded from the offshore structure to the LNG carrier 1 or vice versa.

To prevent direct contact between the LNG carrier 1 and the offshore structure 30 for buffering operation therebetween, a fender 38 is positioned at a lower portion of the column 31 having the column bridge 32. Each of the columns 31 may be provided with a single fender 38.

Figure 12:
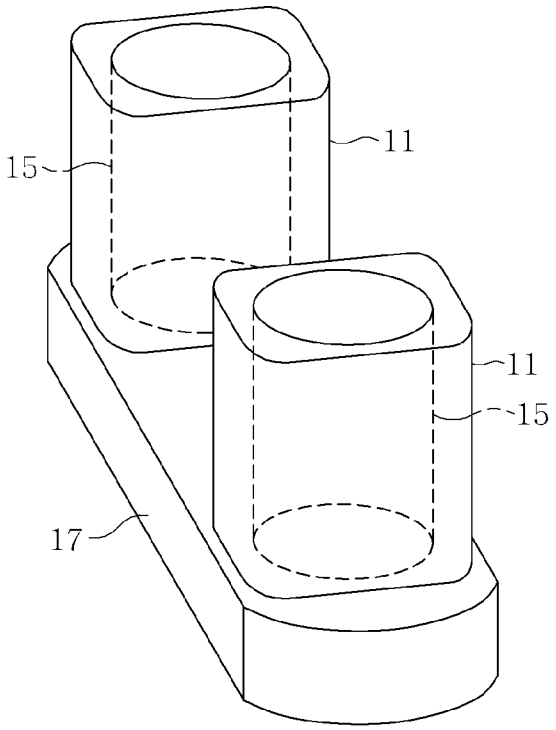
FIGS. 12 and 13 are perspective views of columns having storage tanks of the semi-submersible offshore structure according to the third embodiment of the invention.
Figure 13:
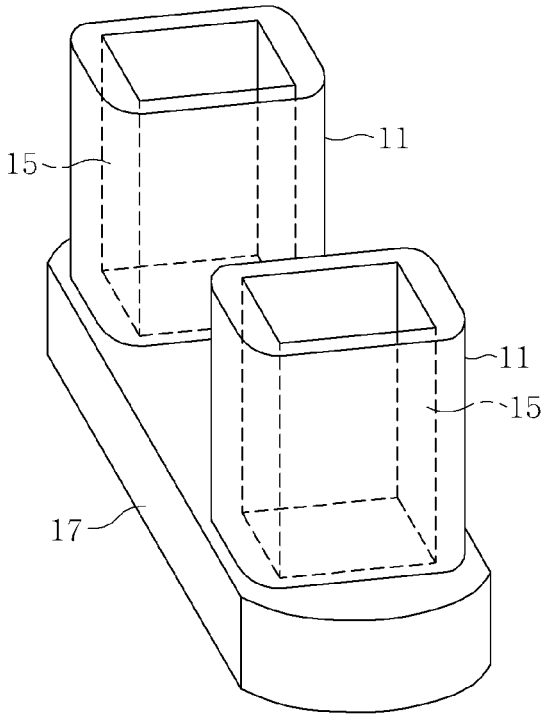

In FIGS. 12 and 13, the column 31 is illustrated as a square pillar shape having rounded edges, but the semi-submersible offshore structure 30 according to the third embodiment may have other shapes of columns. Here, the storage tank 35 in the column 31 is illustrated as having a cylindrical shape in FIG. 12, and is illustrated as a rectangular parallelepiped shape in FIG. 13. However, according to the present invention, the storage tank may have a variety of other shapes, and may have a spherical, cylindrical or rectangular parallelepiped shape in view of manufacturing convenience and costs.

As described above, the semi-submersible offshore structure 30 according to the third embodiment include the plural columns 31 disposed substantially perpendicular to the sea level to have a rig ship structure, the pontoons 37 each connecting the columns 31 to each other, and the storage tanks 35 disposed in the columns 31, so that the offshore structure 30 has an increased width to length ratio.

As a result, the semi-submersible offshore structure 30 according to the third embodiment does not sensitively fluctuate in response to marine conditions, thereby providing stability while significantly reducing the sloshing phenomenon. Further, the upper deck 33 of the offshore structure 30 has an increased area compared with the conventional offshore structure, thereby facilitating arrangement and design of various systems thereon.

Further, since the semi-submersible offshore structure 30 can reduce the influence of sloshing, storage tanks having a large volume can be disposed in the columns so as to ensure a sufficient storage capacity of the storage tank 35.

Furthermore, since the semi-submersible offshore structure 30 is not sensitive to marine conditions and fluctuates less, relative movement between the offshore structure 30 and the LNG carrier 1 is reduced during an offloading operation for unloading or loading liquefied gas from the offshore structure 30 to the LNG carrier 1 or vice versa, thereby providing superior workability.

As apparent from the above description, the semi-submersible offshore structure according to the present invention does not fluctuate sensitively in any marine condition while providing as much storage capacity as possible.

With this configuration, the semi-submersible offshore structure can improve workability in marine offloading of LNG stored in storage tanks while reducing an influence of sloshing.

Although some exemplary embodiments have been described herein, it will be apparent to those skilled in the art that the embodiments are given by way of illustration, and that various modifications and changes can be made without departing from the spirit and scope of the present invention. Accordingly, the scope of the present invention should be limited only by the accompanying claims and equivalents thereof.

What is claimed:

1. A semi-submersible offshore structure configured to be anchored at sea and for storing liquefied gas, comprising:

a plurality of liquefied gas storage tanks configured to store liquefied natural gas, wherein each of said liquefied gas storage tanks is a membrane type storage tank and has a shape selected from a cylindrical shape and a rectangular parallelepiped shape;

a plurality of columns configured to be partially submerged below sea level and standing perpendicular to sea level, wherein each of said plurality of columns is provided therein with at least one of said liquefied gas storage tanks;

pontoons configured to adjust ballast and each pontoon connecting lower sides of the columns to each other;

an upper deck located on the plurality of columns and configured to connect the columns to each other; and a column bridge provided to the columns to bridge a liquefied natural gas (LNG) carrier to the semi-submersible offshore structure, wherein said column bridge is provided in parallel to the pontoons to connect upper portions of the columns to each other under the upper deck, wherein said column bridge connects columns which are connected by each of the pontoons, and wherein each pontoon is configured to reduce fluctuation of the semi-submersible offshore structure and to adjust ballast.

2. The semi-submersible offshore structure according to claim 1, wherein each of the pontoons connects two or more columns to each other.

3. The semi-submersible offshore structure according to claim 1, wherein the column bridge connects adjacent columns to each other, and comprises a mooring rope securing the LNG carrier and an offloading arm transferring liquefied gas between the LNG carrier and the semi-submersible offshore structure.

4. The semi-submersible offshore structure according to claim 1, wherein the column bridge is positioned at an installation height corresponding to a deck height of the LNG carrier.

5. The semi-submersible offshore structure according to claim 1, further comprising:

a fender disposed on an outer surface of the column to prevent direct contact between the semi-submersible offshore structure and the LNG carrier for buffering operation therebetween.

6. The semi-submersible offshore structure according to claim 1, wherein each storage tank is divided into two or more chambers by a partition.

7. The semi-submersible offshore structure according to claim 1, wherein each of the columns has a shape selected from a cylindrical shape and a square pillar shape.

8. The semi-submersible offshore structure according to claim 1, wherein the plurality of columns comprise four columns disposed in an oblong arrangement, and the pontoons comprise a pair of pontoons on each of which two adjacent columns are positioned.

9. The semi-submersible offshore structure according to claim 1, wherein the semi-submersible offshore structure is one selected from LNG FPSO and LNG FSRU.

* * * * *